United States Patent [19]

Suvitie

[11] 4,154,421

[45] May 15, 1979

[54] APPARATUS FOR MOUNTING A CURTAIN BOARD

[76] Inventor: Juhani Suvitie, Kähärintie 6, 20300 Turku 30, Finland

[21] Appl. No.: 855,676

[22] Filed: Nov. 29, 1977

[30] Foreign Application Priority Data

Dec. 3, 1976 [FI] Finland ..... 763487

[51] Int. Cl.[2] ..... B42F 13/00

[52] U.S. Cl. ..... 248/327; 52/484

[58] Field of Search ..... 248/327, 317; 52/460, 52/510, 484, 509; 16/DIG. 40; 85/36

[56] References Cited

U.S. PATENT DOCUMENTS

| | | | |
|---|---|---|---|
| 3,139,162 | 6/1964 | Spangenberg | 52/484 X |
| 3,263,388 | 8/1966 | Bogert | 248/327 |
| 3,264,792 | 8/1966 | Drazdik et al. | 52/509 X |
| 3,415,018 | 12/1968 | Sutter | 52/484 X |
| 3,848,386 | 11/1974 | Catallozzi | 248/317 X |

*Primary Examiner*—J. Franklin Foss
*Attorney, Agent, or Firm*—Francis J. Murphy

[57] ABSTRACT

Apparatus is disclosed for attaching a curtain board to a support surface. Such apparatus includes an elongated fastening member having a base which is adapted to be attached to the support surface. At least two attachment members extend outwardly from the base. Each of these attachment members include two arms of a flexible material which are spaced apart to define a slot and each of these arms includes at least two substantially parallel transverse grooves formed in its surface facing the slot.

At least two connectors are attached to and extend outwardly from the curtain board at positions such that the connectors will mate with the attachment members. Each of the connectors includes a central shaft attached to the curtain board and a plurality of projections extending transversely outwardly from the central shaft. The connectors are insertable into the attachment members such that the transversely extending projections on the connectors engage with and are supported by the grooves in the arms of the attachment members.

7 Claims, 7 Drawing Figures

Figure 1:
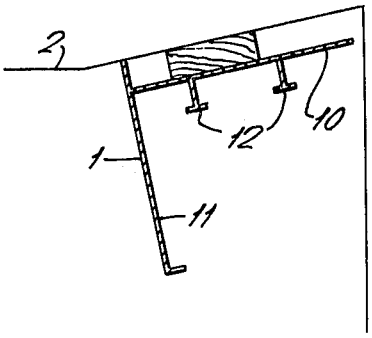
Fig. 1. PRIOR ART

3
13
4
9
5
12
10
11

13
4
5
9
10

APPARATUS FOR MOUNTING A CURTAIN BOARD

This invention relates to a method for fastening a curtain board to a ceiling or to the lower surfaces of supports fastened to a wall, so that one or several fastening pieces are fastened to the ceiling or to the support fastened to the wall, the lower surface of the fastening piece or pieces being provided with at least two grooves and the upper surface of the curtain board being correspondingly provided with at least two longitudinal ridges or with pegs, and/or the lower surface of the fastening piece or pieces being provided with at least two ridges or with pegs and the upper surface of the curtain board being correspondingly provided with at least two longitudinal ridges. The invention also relates to a fastening piece for applying the method.

Manufacturing of plastic curtain boards by extrusion has been started recently. The manufacturing costs of this kind of curtain boards extruded in one piece are considerably lower than the costs of common prior art boards made of wood or chip board. However, the use of extruded curtain boards has so far been quite restricted. Their wider marketing has been prevented by problems encountered in the mounting of the boards.

Curtain boards have been fastened to a ceiling or to a support fastened to a wall usually by means of screws or by "shooting." However, usually there are always unevennesses in ceilings, and the direction of ceilings differs from the horizontal direction. If the ceiling surface is somewhat slanted in the transverse direction of the curtain board and the curtain board is fastened to the ceiling, the bottom board of the curtain board will take a position according to the inclination of the ceiling. The planar front section positioned at an angle of 90° to the planar base section will consequently also take a slanted position instead of a vertical position. Even more awkward are projections or protusions and recesses in the ceiling in the longitudinal direction of the curtain board. If the direction of the ceiling surface differs from the horizontal direction in the longitudinal direction of the curtain board, a curtain board fastened to the ceiling tends to follow these skewnesses and to bend into an arc. In this case the front section of a plastic curtain board in one piece warps and twists along a length considerably longer than the distance in which slanting appears in the ceiling.

When a curtain board is fastened to a wall by means of supports, it is often found that a hole drilled in the wall did not fall exactly to the point where it was intended. The reason for this is usually stones or irons in a concrete wall which transfer the point of the drill nearly without an exception to one direction or other. A similar problem occurs when threaded bolts are shot into a wall.

A method according to the invention is mainly characterized in that the ridges or pegs are pushed into the grooves into a desired depth while the surface of the ridges or pegs and/or grooves is of elastic material, and the shape and dimensioning of the grooves and ridges or pegs is such that the ridges or pegs stay in the grooves in the desired depth carrying the curtain board. The invention results in a curtain board fastening means which is very easily adjusted in the vertical direction. In case the direction of the ceiling deviates from the horizontal direction, the direction of the curtain board is adjusted by pressing the board in places deeper into the fastening pieces than in other places. The problems encountered when using extruded curtain boards can be eliminated by means of a fastening method according to the invention. In this way, economical plastic curtain boards are competitive also in the shape maintaining appearance.

Figure 2:
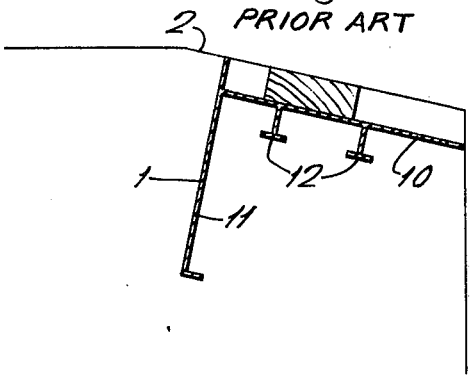
Fig. 2. PRIOR ART
Figure 3:
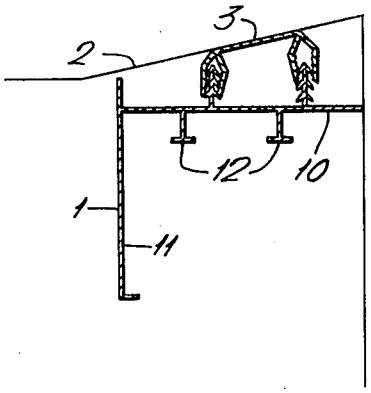
Figure 4:
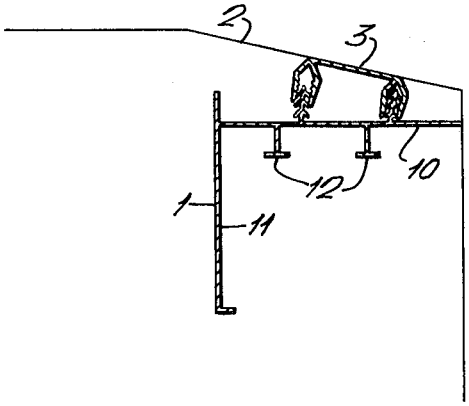
Figure 5:
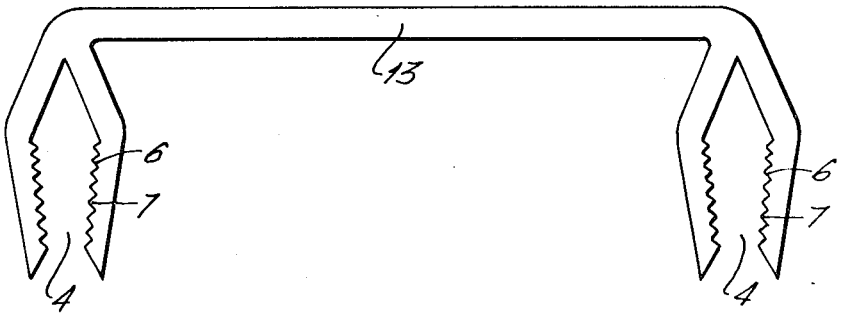
Figure 6:
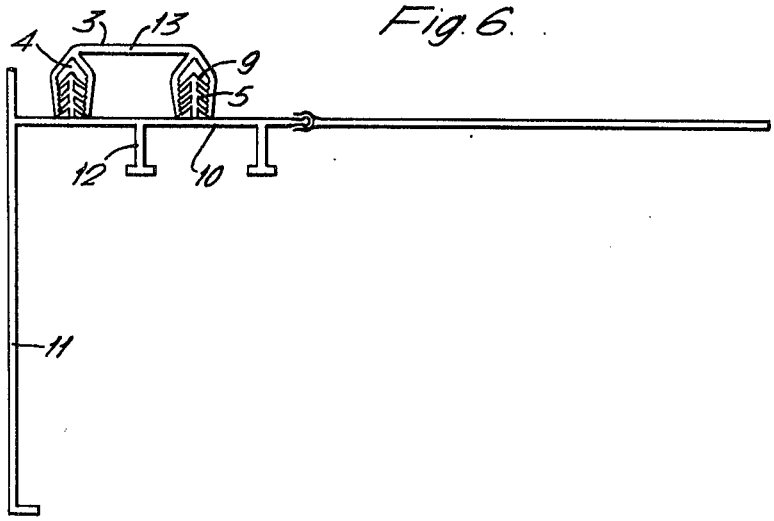
Figure 7:
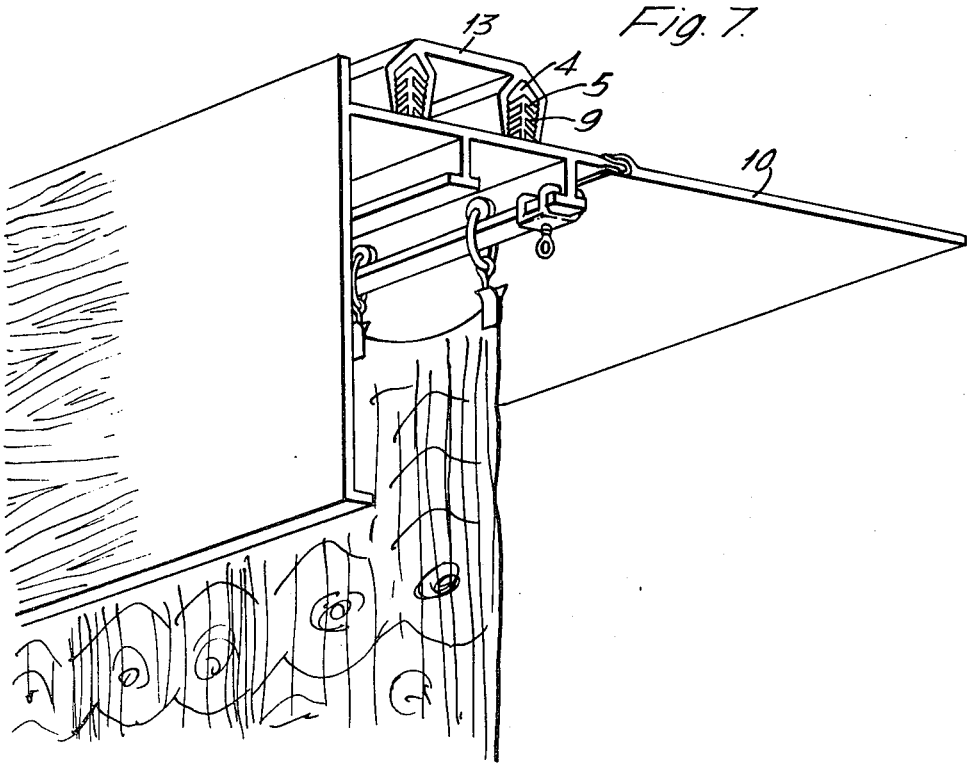

The invention is described in detail in the following with reference to the accompanying drawings, in which FIGS. 1 and 2 show cross sections of curtain boards fastened to a skew ceiling in a conventional way, FIGS. 3 and 4 show cross sections of curtain boards fastened to a correspondingly skew ceiling by means of a method according to the invention, FIG. 5 shows a cross section of one embodiment of a fastening piece according to the invention, FIG. 6 shows a cross section of a curtain board fastened into the fastening piece of FIG. 5, and FIG. 7 shows a perspective view of the same curtain board.

FIG. 1 shows somewhat exaggratingly a situation where an L-shaped curtain board 1 in one piece has been fastened to a ceiling 2, which is slanting in such a way that it rises towards the window wall. In FIG. 2 the ceiling surface is slanting in opposite direction. The base section 10 of the curtain board 1, which is meant to be in horizontal position follows the direction of the ceiling. The front section 11 which is positioned at and angle of 90° to the front edge of the base section, takes correspondingly a slanted position and not the intended vertical position. Rails 12 are provided at the lower surface of the base section for carrying the curtains. FIG. 3 shows a curtain board fastened to the ceiling by means of a method according to the invention. The slanting of the ceiling corresponds to the slanting of the ceiling in FIG. 1. The slanting of the ceiling of FIG. 4 corresponds to the slanting of the ceiling of FIG. 2.

It can be seen that even though the ceiling is slanted, the curtain board can be fastened so that its base section 10 is in horizontal direction and the front section 11 is in vertical direction.

FIG. 5 shows a cross section of one embodiment of a fastening piece 3 according to the invention. The fastening piece 3, which can be extruded of plastic, for instance, has two downwards opening grooves in the longitudinal direction of the curtain board. The side walls of the grooves are provided with waving or ridges 6 which run in the longitudinal direction of the groove. The fastening piece is fastened at its horizontal base section 13 in a suitable way to the ceiling or to some other corresponding fastening surface.

FIGS. 6 and 7 show a curtain board 1, extruded of plastic, which has been pressed into a fastening piece 3 shown in FIG. 5. The curtain board has in the upper surface of its base section 10 two ridges 5 in the longitudinal direction of the curtain board. The sides of the ridge 5 of the curtain board are provided with longitudinal projecting members 9, which preferably are continuous in the longitudinal direction of the curtain board and are directed sideways and somewhat downwards from the sides of the ridge 5. The projections 9 of the curtain board made of plastic are elastic, and when the ridges 5 of the curtain board 1 are pressed into the grooves of the fastening piece 3 into a desired depth, the projecting members 9 of the ridges 5 are pressed against the sides of the grooves 3 and they keep the curtain board in this desired depth. In this way the curtain board is fastened by means of them.

The fastening piece 3 can extend along the entire length of the curtain board. However, this is not necessary, and preferably about 5 to 10 cm long fastening pieces are used. Several of these are fastened to the ceiling at suitable spacings.

Besides to a ceiling, a curtain board can be fastened according to the invention also to supports fastened to a wall. When fastening pieces according to the invention are used, the supports fastened to the wall may be at somewhat different heights, and they need not necessarily be along the same horizontal line. The gastening pieces 3 are fastened to the lower surfaces of the supports and the curtain board is fastened by pressing it into a required depth. In this way, the curtain board itself will be in horizontal position even if the supports were at different heights.

The invention is not restricted to the above embodiment and it may vary considerably within the scope of the claims.

The grooves and ridges may be arranged in the opposite way to the one described above. In other words, the fastening piece may have ridges and the curtain board then has corresponding grooves. The sides of the grooves may also be smooth. The shape of the sides of the ridges may also vary. Instead of plastic fastening pieces, also wooden fastening pieces can be used. Instead of ridges, the fastening pieces and the curtain board may have pegs or rows of pegs. The main thing is that the members in the fastening piece and curtain board fitting together are shaped and dimensioned so that when the curtain board has been pressed into a desired position, it maintains this position. Either the grooves or the ridges (or pegs) or both have to be made of somewhat resilient material so that when the ridges or pegs are suitably shaped, they maintain the position into which they have been pressed in the grooves. When necessary, the curtain board can be easily removed by means of a heavy jerk or pull at one end so that the end comes off and the whole board can then be loosened.

I claim:

1. Apparatus for attaching a curtain board to a support surface including:

an elongated fastening member including a base adapted to be attached to said support surface and at least two attachment members extending outwardly from said base, each of said attachment members including two arms of a flexible material which are spaced apart to define a slot therebetween each of said arms having at least two substantially parallel transverse grooves formed in the surface of such arm facing said slot; and at least two connectors attached to and extending outwardly from said curtain board at positions such that said connectors will mate said attachment members, each of said connectors including a central shaft attached to said curtain board and a plurality of projections extending transversely outwardly from said central shaft, said connectors being insertable into said attachment members such that said transversely extending projections on said connectors engage with and are supported by said grooves in the arms of said attachment means.

2. Apparatus as claimed in claim 1 in which said base member and said attachment members form a single plastic piece.

3. Apparatus as claimed in claim 1 in which said curtain board and said connectors comprise a single plastic piece.

4. Apparatus as claimed in claim 1 in which said transversely extending projections of said connectors extending outwardly and downardly toward the curtain board.

5. Apparatus as claimed in claim 1 in which the transverse projections of said connectors are made of a flexible material.

6. Apparatus as claimed in claim 1 in which the arms of said attachment members are attached at a common point to said base member and a first portion of said arms extend outwardly therefrom and away from each other to a first point and then a second portion of said arms are angled inwardly toward each other to their respective ends and in which the grooves are formed in the second portion of each of said arms.

7. Apparatus as claimed in claim 6 in which the ends of each of said arms of said attachment members are beveled on the surfaces defining said slot.

* * * * *

UNITED STATES PATENT OFFICE

CERTIFICATE OF CORRECTION

Patent No. 4,154,421 Dated May 15, 1979

Inventor(s) JUHANI SUVITIE

It is certified that error appears in the above-identified patent and that said Letters Patent are hereby corrected as shown below:

Claim 1, line 20, the word "means" should be --members--

Claim 4, line 29, the word "downardly" should be --downwardly--

Signed and Sealed this

*Eleventh* Day of *September 1979*

[SEAL]

*Attest:*

*Attesting Officer*

LUTRELLE F. PARKER

*Acting Commissioner of Patents and Trademarks*